US005775888A

United States Patent [19]

Sakamoto et al.

[11] Patent Number: 5,775,888

[45] Date of Patent: Jul. 7, 1998

[54] SCROLL FLUID MACHINE HAVING END PLATE WITH GREATER CENTER THICKNESS

[75] Inventors: Susumu Sakamoto, Kanagawa-ken; Yuji Komai, Tokyo; Katsushi Hidano; Yoshio Kobayashi, both of Kanagawa-ken, all of Japan

[73] Assignee: Tokico Ltd., Kawasaki, Japan

[21] Appl. No.: 698,455

[22] Filed: Aug. 15, 1996

[30] Foreign Application Priority Data

Sep. 1, 1995 [JP] Japan ..... 7-248682

[51] Int. Cl.[6] ..... F01C 1/04; F01C 21/06

[52] U.S. Cl. ..... 418/55.2; 418/101

[58] Field of Search ..... 418/55.2, 101

[56] References Cited

U.S. PATENT DOCUMENTS

| | | | |
|---|---|---|---|
| 4,477,238 | 10/1984 | Terauchi | 418/55.2 |
| 5,417,554 | 5/1995 | Kietzman et al. | 418/55.2 |
| 5,496,161 | 3/1996 | Machida et al. | 418/55.2 |

FOREIGN PATENT DOCUMENTS

| | | | |
|---|---|---|---|
| 0075053 | 3/1983 | European Pat. Off. | 418/55.2 |
| 1187390 | 7/1989 | Japan | 418/55.2 |
| 4342801 | 11/1992 | Japan | 418/101 |
| 7-119672 | 5/1995 | Japan . | |

*Primary Examiner*—John J. Vrablik

*Attorney, Agent, or Firm*—Wenderoth, Lind & Ponack

[57] ABSTRACT

A scroll fluid machine includes a fixed scroll member having an end plate which is formed such that a central portion of the end plate which corresponds approximately to 1.5 to 2 turns of a wrap portion from its spiral starting end (innermost end) is a thick-walled portion having a relatively large plate thickness, and an outer peripheral portion of the end plate which lies radially outside the thick-walled portion is a thin-walled portion. The thickness of the thick-walled portion is set to be about 1.4 to 1.6 times the thickness of the thin-walled portion. By reducing thermal resistance at the thick-walled portion of the end plate, heat from compression chambers are conducted to radiating fins, thereby suppressing the transfer of the heat to the thin-walled portion.

4 Claims, 6 Drawing Sheets

SCROLL FLUID MACHINE HAVING END PLATE WITH GREATER CENTER THICKNESS

BACKGROUND OF THE INVENTION

1. Field of the Invention

The present invention relates to a scroll fluid machine which is suitably used as, for example, an air compressor, a vacuum pump, etc. More particularly, the present invention relates to an air-cooled scroll fluid machine.

2. Related Background Art

A known scroll fluid machine is arranged as follows: A fixed scroll member is secured to a casing. The fixed scroll member has a spiral wrap portion extending from an end plate. A driving shaft is rotatably provided in the casing. The driving shaft has a crank which is formed by its distal end portion extending into the casing. An orbiting scroll member is orbitably mounted on the crank of the driving shaft in the casing. The orbiting scroll member has a spiral wrap portion extending from an end plate so as to overlap the wrap portion of the fixed scroll member. A plurality of compression chambers are defined between the wrap portions of the orbiting and fixed scroll members. A suction port is formed in the fixed scroll member so as to communicate with the outermost one of the compression chambers. A discharge port is formed in the fixed scroll member so as to communicate with the central (innermost) one of the compression chambers.

When a scroll fluid machine of the type described above is used as an air compressor, the driving shaft is driven to rotate by an external drive unit, for example, an electric motor, thereby causing the orbiting scroll member to orbit. Thus, air that is sucked in through the suction port is compressed in each of the compression chambers defined between the orbiting and fixed scroll members, and the compressed air is discharged from the discharge port to an external air tank or the like.

In the conventional scroll air compressor, a sealing member such as a tip seal is fitted on the tip of each of the wrap portions of the fixed and orbiting scroll members. The sealing members of the mating wrap portions are brought into sliding contact with the surfaces of each other's end plates, thereby sealing each of the compression chambers formed between the orbiting and fixed scroll members, and thus preventing the compressed air from leaking out from a higher-pressure compression chamber to a lower-pressure compression chamber.

In the conventional scroll air compressor, heat of compression is generated in each compression chamber during the compression operation. Therefore, the wrap portions of the fixed and orbiting scroll members are likely to be distorted or deformed on account of thermal expansion or nonuniform temperature distribution. To cope with such problems, the conventional scroll air compressor takes measures wherein the fixed and orbiting scroll members are cooled (air-cooled) by circulating cooling air inside and outside the casing.

With the case of the above-described conventional technique, however, the fixed and orbiting scroll members are merely cooled (air-cooled) by circulating cooling air inside and outside the casing. Such cooling scheme is not necessarily satisfactory.

Under these circumstances, the present inventors examined whether it would be useful to change the thickness of an end plate as a scheme of cooling the fixed and orbiting scroll members.

However, if the thickness of an end plate is reduced, high-temperature heat of compression that is generated in the central compression chamber cannot effectively be radiated (dissipated) from the central portion of the end plate, resulting in a considerable rise in the temperature of the central portion of the end plate, and thus causing the lifetime of the tip seal to be shortened.

If the thickness of an end plate is increased, it becomes easier for high-temperature heat of compression generated in the central compression chamber to be transferred from the central portion of the end plate toward the outer periphery thereof. Consequently, the temperature at the outer periphery of the end plate is also raised, causing a rise in temperature (intake temperature) of air or other fluid that is sucked in through the suction port at the outer periphery of the end plate, and resulting in a reduction of the compression efficiency.

If the thickness of the end plate of the orbiting scroll member is increased, the overall weight of the orbiting scroll member increases, and it becomes necessary to increase the size of a balance weight, bearings, etc., causing the overall size of the machine to increase.

SUMMARY OF THE INVENTION

In view of the above-described problems of the related background art, an object of the present invention is to provide a scroll fluid machine which is designed so that high-temperature heat of compression generated in the central compression chamber can be effectively prevented from being transferred from the center of an end plate toward the outer periphery thereof, thereby enabling the compression efficiency to be surely improved, and that the heat can be radiated from the central portion of the end plate to the outside, thereby enabling the machine to have improved durability and operating life.

The present invention may be applied to a scroll fluid machine having a casing, a fixed scroll member secured to the casing and having a spiral wrap portion extending from an end plate, an orbiting scroll member provided in the casing so as to face the fixed scroll member and having a spiral wrap portion extending from an end plate, and a plurality of compression chambers defined between the wrap portions of the orbiting and fixed scroll members.

According to the present invention, at least one of the end plates of the fixed and orbiting scroll members is formed such that the plate thickness is greater at the center of the end plate than at the outer periphery thereof.

The above-described end plate may have a plurality of radiating fins formed on a side thereof which is remote from the side where the wrap portion is provided so that heat transferred from the compression chambers to the end plate is radiated to the outside through the radiating fins.

The above-described end plate may be formed such that a portion of the end plate which corresponds to 1.5 to 2 turns of the wrap portion from its spiral starting end lying at the center of the end plate is a thick-walled portion having a relatively large plate thickness, and an outer peripheral portion of the end plate which lies radially outside the thick-walled portion is a thin-walled portion having a relatively small plate thickness.

DETAILED DESCRIPTION OF PREFERRED EMBODIMENTS

Embodiments of the scroll fluid machine according to the present invention will be described below with reference to FIGS. 1 to 6 by way of examples in which the present invention is applied to scroll air compressors.

FIGS. 1 to 4 show a first embodiment of the present invention.

Figure 1:
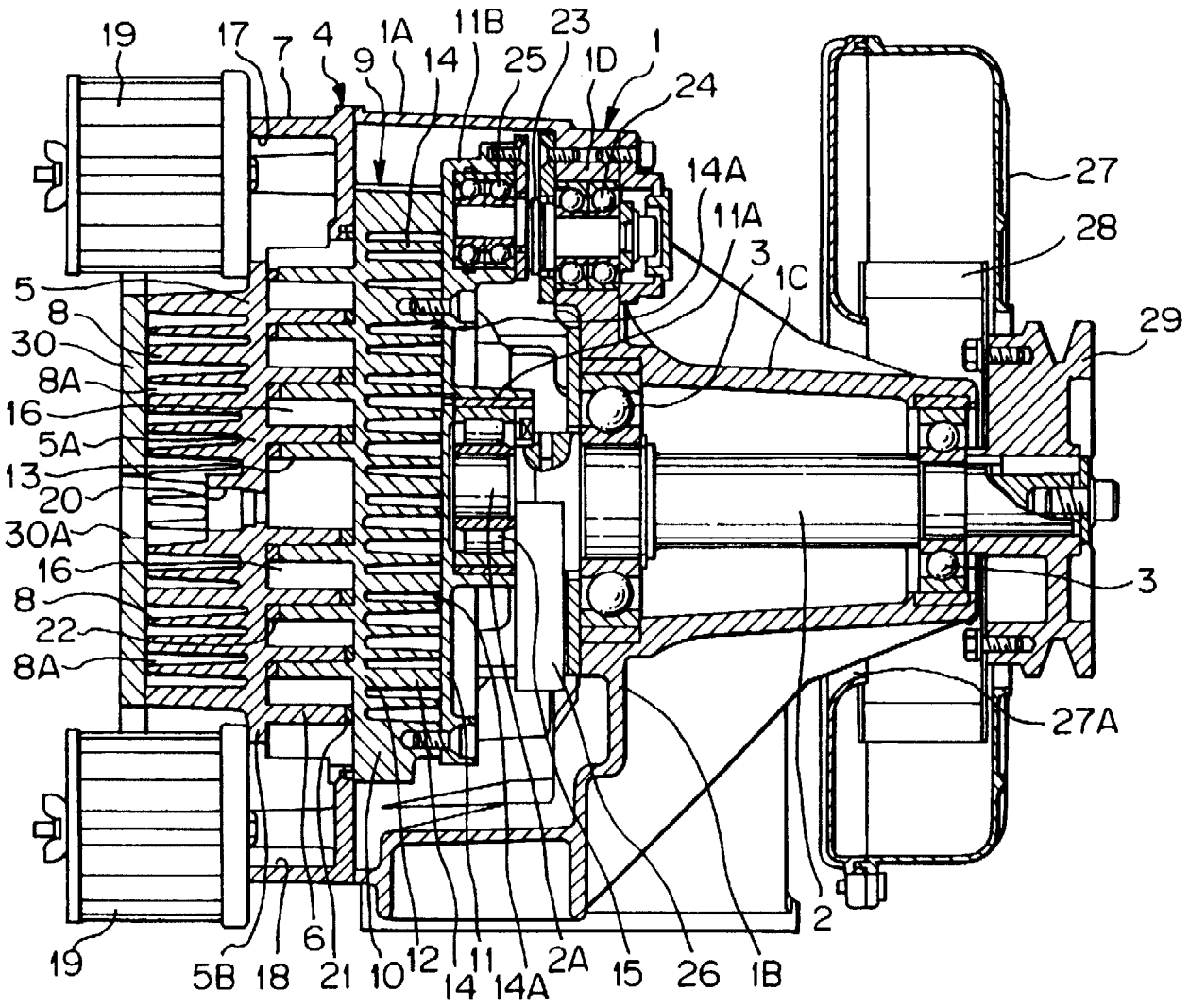
FIG. 1 is a longitudinal sectional view of a scroll air compressor according to a first embodiment of the present invention.

In such figures, a scroll air compressor casing 1 is formed in the shape of a stepped cylinder. The casing 1 has a large-diameter cylindrical portion 1A, and an annular portion 1B extending radially inward from one end of the cylindrical portion 1A. The casing 1 further has a cylindrical bearing portion 1C axially extending from the inner periphery of the annular portion 1B in a direction opposite to the direction of projection of the cylindrical portion 1A. The outer peripheral portion of the annular portion 1B is provided with three (for example) mounting portions 1D (only one of them is shown in FIG. 1) for mounting auxiliary cranks 23 (described later). The mounting portions 1D are circumferentially spaced at predetermined intervals.

A driving shaft 2 is rotatably provided in the cylindrical bearing portion 1C through bearings 3. A distal end portion of the driving shaft 2 is a crank 2A extending into the cylindrical portion 1A of the casing 1. The axis of the crank 2A is eccentric with respect to the axis of the driving shaft 2 by a predetermined dimension. The driving shaft 2 projects from one end of the cylindrical bearing portion 1C into a fan casing 27 (described later). The projecting end portion of the driving shaft 2 is provided with a pulley 29 (described later).

Figure 3:
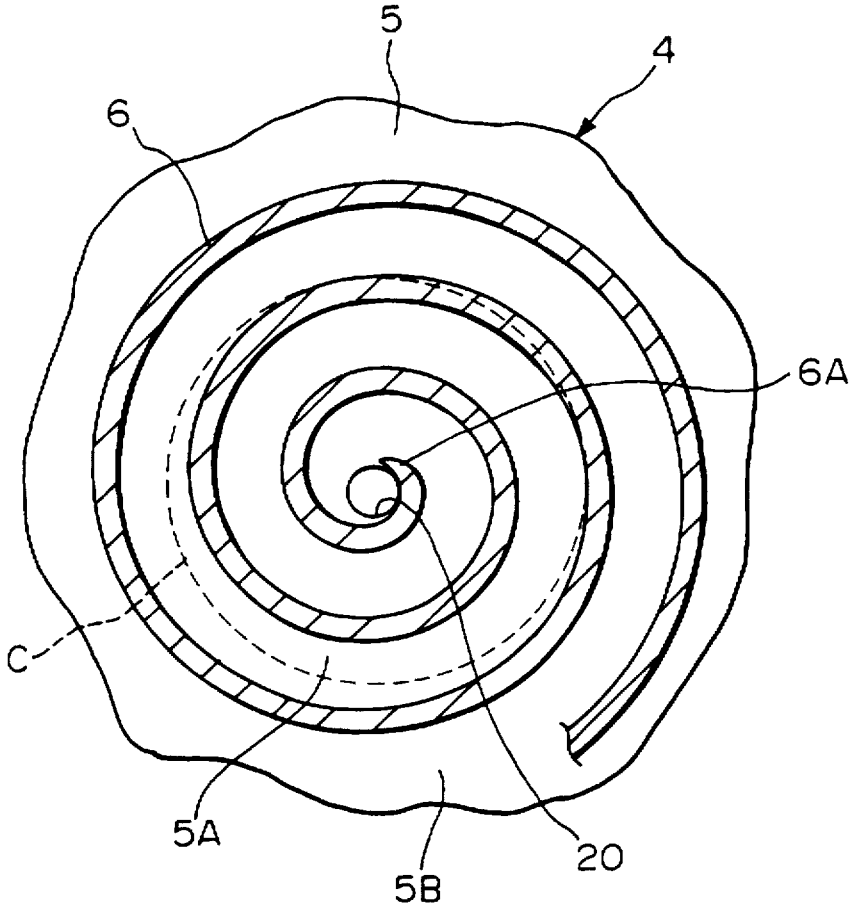
FIG. 3 is a sectional view taken along the line III—III in FIG. 2.

A fixed scroll member 4 is secured to the cylindrical portion 1A of the casing 1. The fixed scroll member 4 has a disk-shaped end plate 5 which is placed such that the center of the end plate 5 coincides with the axis of the driving shaft 2. A spiral wrap portion 6 is provided on the end plate 5 so as to project axially from the surface (bottom) of the end plate 5. As shown in FIG. 3, the center of the wrap portion 6 is a spiral starting end 6A, and the outer peripheral end of the wrap portion 6 is a spiral terminating end. An outer edge portion 7 is integrally formed with a radially outside portion of the end plate 5 so as to surround the wrap portion 6. The outer edge portion 7 is mounted on the cylindrical portion 1A of the casing 1 through bolts (not shown). A large number of radiating fins 8 are provided on the back of the end plate 5 (i.e., a side remote from the side where the wrap portion 6 is provided).

The radiating fins 8 extend parallel to each other from the back of the end plate 5 to form cooling air passages 8A between them and a duct cover 30 (described later). The radiating fins 8 are arranged such that cooling air generated by a centrifugal fan 28 (described later) circulates linearly through the cooling air passages 8A, thereby radiating heat of compression (described later) from the back of the end plate 5, and thus cooling the fixed scroll member 4 as a whole.

Figure 2:
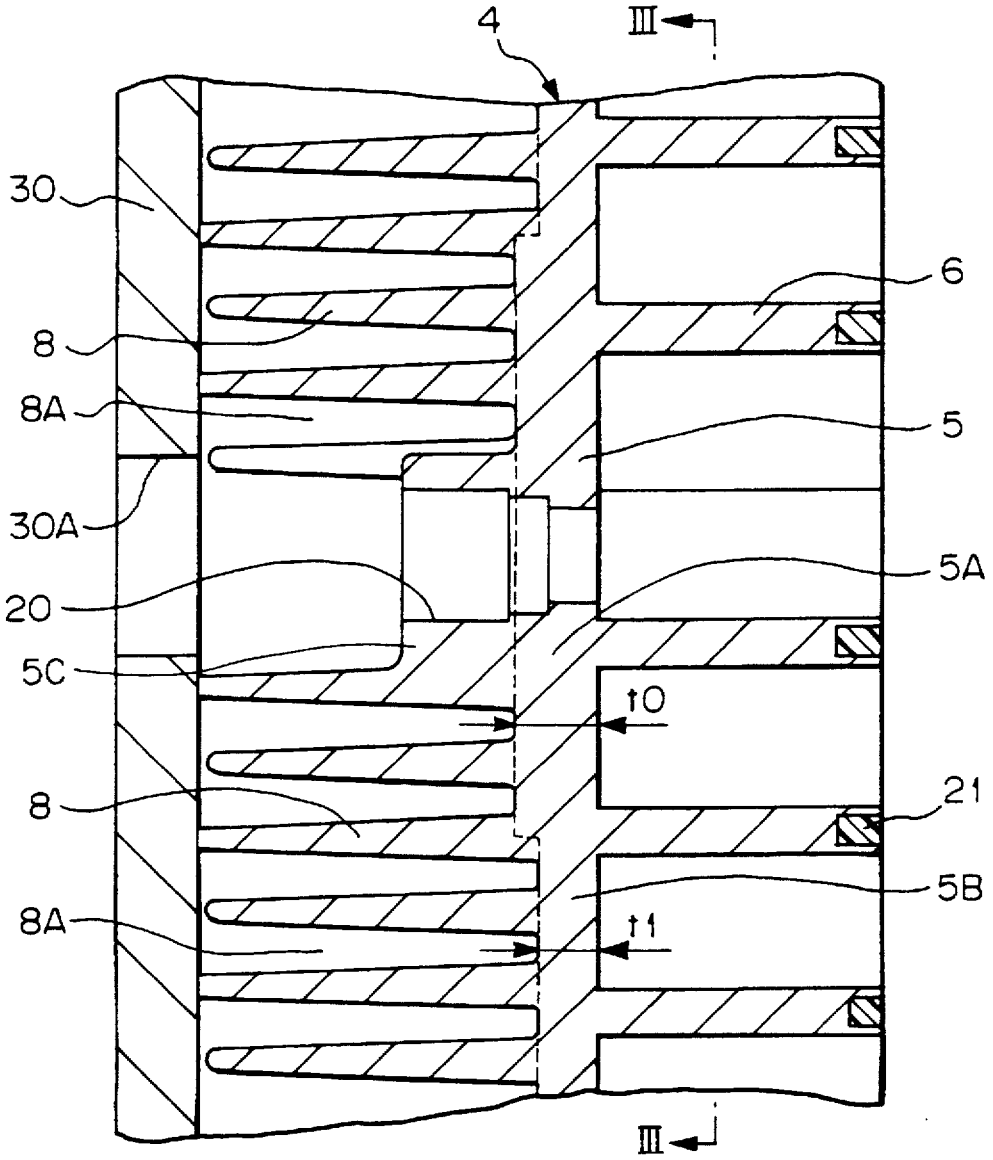
FIG. 2 is an enlarged fragmentary sectional view of a fixed scroll member shown in FIG. 1.

As shown in FIG. 3, the end plate 5 of the fixed scroll member 4 is formed such that a central portion (portion inside the circle C shown by the dotted line) of the end plate 5 which corresponds to 1.5 to 2 turns of the wrap portion 6 from the spiral starting end 6A (i.e., the innermost end) is a thick-walled portion 5A having a relatively large plate thickness, and an outer peripheral portion of the end plate 5 which lies radially outside the thick-walled portion 5A is a thin-walled portion 5B having a relatively small plate thickness. As shown in FIG. 2, the thickness t0 of the thick-walled portion 5A and the thickness t1 of the thin-walled portion 5B are set to be $t0=(1.4 \text{ to } 1.6)\times t1$, for example. The thick-walled portion 5A has a heat capacity (plate thickness) sufficiently large to enable the heat of compression generated from compression chambers 16 (described later) to be readily conducted to the radiating fins 8. In other words, the thick-walled portion 5A reduces resistance (thermal resistance) to the heat of compression.

The thin-walled portion 5B, which lies at the outer periphery of the end plate 5 (i.e., at a position outside a portion corresponding approximately to the 2nd turn of the wrap portion 6 from the spiral starting end 6A), has a relatively thin wall so as to give a high resistance (thermal resistance) to heat from the thick-walled portion 5A as it is conducted through the thin-walled portion 5B. Thus, the thin-walled portion 5B is maintained in lower temperature conditions than the thick-walled portion 5A. The thin-walled portion 5B of the end plate 5 is adapted to suppress a temperature rise of intake air from suction ports 17 and 18 (described later) caused by contact with the thin-walled portion 5B.

An orbiting scroll member 9 is orbitably provided in the cylindrical portion 1A of the casing 1 so as to face the fixed scroll member 4. The orbiting scroll member 9 has an orbiting scroll body 10 and a back plate 11 which is secured to the orbiting scroll body 10. The orbiting scroll body 10 has an arrangement approximately similar to that of the fixed scroll member 4. That is, the orbiting scroll body 10 has an end plate 12, a spiral wrap portion 13, etc.

The back plate 11 is secured to the back (reverse side) of the end plate 12 through bolts. The back plate 11 has a boss portion 11A integrally formed at the center thereof to retain an orbiting bearing 15 (described later). The outer peripheral portion of the back plate 11 is provided with mounting portions 11B (only one of them is shown in FIG. 1) for mounting auxiliary cranks 23. The mounting portions 11B are circumferentially spaced at predetermined intervals, lying at respective positions substantially facing the mounting portions 1D of the casing 1.

Radiating fins 14 are provided between the end plate 12 of the orbiting scroll body 10 and the back plate 11. The radiating fins 14 are disposed to form cooling air passages 14A on the back of the end plate 12. The cooling air passages 14A are linear U-shaped grooves extending parallel to each other. The radiating fins 14 radiate heat from the back of the end plate 12 and from the boss portion 11A by circulating cooling air from the centrifugal fan 28 through the cooling air passages 14A, thereby cooling the end plate 12 and the boss portion 11A.

Orbiting bearing 15 is fitted in the boss portion 11A of the back plate 11. The crank 2A of the driving shaft 2 is fitted to the inner periphery of the orbiting bearing 15. Thus, the orbiting bearing 15 rotatably supports the orbiting scroll member 9 with respect to the crank 2A of the driving shaft 2.

A plurality of compression chambers 16 are defined between the wrap portion 6 of the fixed scroll member 4 and the wrap portion 13 of the orbiting scroll member 9. Each compression chamber 16 has an approximately crescent-shaped configuration. As the orbiting scroll member 9 revolves, the compression chambers 16 continuously reduce in size between the wrap portions 6 and 13, thereby successively compressing air sucked in through suction ports 17 and 18 (described later) and discharging the compressed air from a discharge port 20 (described later). It should be noted that the wrap portion 13 of the orbiting scroll member 9 is disposed so as to overlap the wrap portion 6 of the fixed scroll member 4 with a predetermined offset angle (e.g., 180 degrees).

First and second suction ports 17 and 18 are provided in the outer edge portion 7 of the fixed scroll member 4. The suction ports 17 and 18 lie radially outside the end plate 5. As shown in FIG. 1, the suction ports 17 and 18 are 180 degrees spaced apart from each other in the circumferential direction of the end plate 5 so as to face each other across the cooling air passages 8A, defined by the radiating fins 8, in the vertical direction as viewed in FIG. 1. The suction ports 17 and 18 are communicated with the outermost compression chamber 16, thereby allowing outside air (intake air) to be sucked into the compression chambers 16 through suction filters 19.

Discharge port 20 is provided in a center area 5C of the end plate 5 of the fixed scroll member 4. As shown in FIGS. 1 and 2, center area 5C is not provided with fins 8, and fins 8 surround center area 5C. The discharge port 20 is communicated with the innermost (central) compression chamber 16 and also connected to an external air tank (not shown) through an air pipe (not shown). During operation of the scroll air compressor, air sucked in through the suction ports 17 and 18 according to the orbiting operation of the orbiting scroll member 9 is successively compressed in the compression chambers 16, and the compressed air is discharged to the outside from the central compression chamber 16 through the discharge port 20.

Tip seals 21 and 22 are sealing members fitted on the tips of the wrap portions 6 and 13 of the fixed and orbiting scroll members 4 and 9. The tip seals 21 and 22 are continuous string-shaped seals formed of an elastic resin material, and extend spirally along the respective tips of the wrap portions 6 and 13. During the orbiting operation of the orbiting scroll member 9, the tip seals 21 and 22 are kept in sliding contact with the surfaces (bottoms) of the end plates 12 and 5, which are mated with the tip seals 21 and 22, thereby air-tightly sealing the compression chambers 16, and thus preventing the compressed air from leaking out from a higher-pressure compression chamber 16 to a lower-pressure compression chamber 16.

Auxiliary cranks 23 (only one of them is shown in FIG. 1) are circumferentially spaced at predetermined intervals between the annular portion 1B of the casing 1 and the back plate 11 of the orbiting scroll member 9 to form a rotation preventing mechanism. Each auxiliary crank 23 is rotatably supported at one end thereof in a respective mounting portion 1D of the casing 1 through a bearing 24. The other end of each auxiliary crank 23 is rotatably supported in a respective mounting portion 11B of the back plate 11 through a bearing 25. Each auxiliary crank 23 has a predetermined amount of eccentricity as is the case with the crank 2A of the driving shaft 2, thereby preventing the orbiting scroll member 9 from rotating on its own axis during the orbiting operation.

A balance weight 26 is secured to the driving shaft 2 at a position between the annular portion 1B of the casing 1 and the boss portion 11A of the back plate 11. The balance weight 26 balances the whole driving shaft 2 with respect to the orbiting motion of the orbiting scroll member 9.

Fan casing 27 is mounted on one end of the cylindrical bearing portion 1C of the casing 1. The fan casing 27 has an approximately spiral configuration. An inner peripheral portion of the fan casing 27 opens to the outside as a cooling air inlet 27A. An outer peripheral portion of the fan casing 27 is communicated with a cooling air duct (not shown). The cooling air duct extends outside the casing 1 toward the fixed scroll member 4. The cooling air duct allows cooling air from centrifugal fan 28 to circulate through the cooling air passages 14A on the orbiting scroll member 9 and through the cooling air passages 8A on the fixed scroll member 4.

The centrifugal fan 28 is secured to the projecting end of the driving shaft 2 through the pulley 29 in the fan casing 27. The centrifugal fan 28 rotates together with the driving shaft 2, thereby taking outside air into the fan casing 27. In this way, the centrifugal fan 28 generates cooling air and forcedly circulates the cooling air into the cooling air duct. The pulley 29 is connected to an electric motor (not shown) as a drive source through a belt (not shown) to transmit rotational force from the electric motor to the driving shaft 2 and also to the centrifugal fan 28.

Duct cover 30 is disposed at the back of the fixed scroll member 4. The duct cover 30 is secured to the fixed scroll member 4 so as to cover the distal ends of the radiating fins 8 at the back of the end plate 5, thereby forming cooling air passages 8A between the duct cover 30 and the radiating fins 8. A pipe inserting hole 30A is provided in the center of the duct cover 30. The above-described air pipe, which connects with the discharge port 20, is inserted into the pipe inserting hole 30A.

The scroll air compressor according to this embodiment, arranged as described above, operates as follows:

First, when the driving shaft 2 is driven to rotate by the electric motor through the pulley 29, the rotation of the driving shaft 2 is transmitted from the crank 2A to the orbiting scroll member 9 through the orbiting bearing 15. Consequently, the orbiting scroll member 9 orbits about the axis of the driving shaft 2 while being prevented from rotating on its own axis by the auxiliary cranks 23. The orbiting motion causes the compression chambers 16, defined between the wrap portions 6 and 13, to reduce continuously. Thus, in the scroll air compressor, air sucked in through the suction ports 17 and 18 is successively compressed in the compression chambers 16, and the compressed air is discharged from the discharge port 20 into the external air tank (not shown).

Thus, according to this embodiment, the end plate 5 of the fixed scroll member 4 is formed such that a central portion of the end plate 5 which corresponds to 1.5 to 2 turns of the wrap portion 6 from the spiral starting end 6A (i.e., the innermost end) is a thick-walled portion 5A having a relatively large plate thickness, and an outer peripheral portion of the end plate 5 which lies radially outside the thick-walled portion 5A is a thin-walled portion 5B having a relatively small plate thickness. Further, the thickness of the thick-walled portion 5A is set to be about 1.4 to 1.6 times the thickness of the thin-walled portion 5B. Accordingly, thermal resistance is reduced at the thick-walled portion 5A of the end plate 5, thereby enabling heat of compression from the compression chambers 16 to be efficiently conducted toward the radiating fins 8. The heat can be surely dissipated to the cooling air passages 8A through the radiating fins 8. In addition, high thermal resistance can be given to the thin-walled portion 5B at the outer periphery of the end plate 5. Thus, it is possible to limit the transfer of the compression heat from the thick-walled portion 5A to the thin-walled portion 5B.

Figure 4:
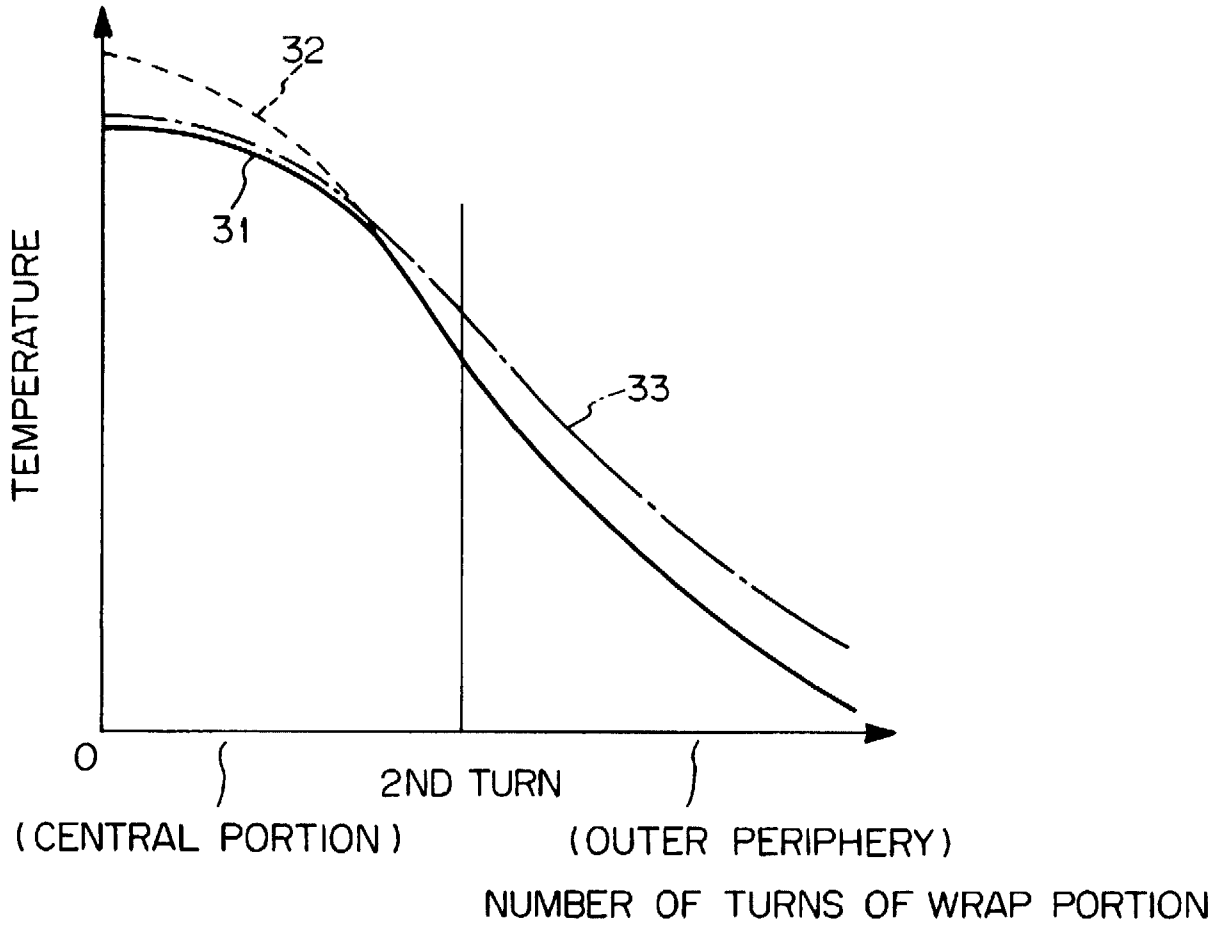
FIG. 4 shows temperature distributions from a central portion to an outer periphery of an end plate.

As a result, the thin-walled portion 5B can be maintained in lower temperature conditions than the thick-walled portion 5A, as shown by the solid-line characteristic curve 31 in FIG. 4. Therefore, it is possible to considerably reduce the possibility that air sucked in through the suction ports 17 and 18 will be subjected to heat conduction or radiation heat from the end plate 5 and the outer peripheral portion of the wrap portion 6 in the process of reaching the outermost compression chamber 16. Thus, the rise in temperature of the intake air can be effectively suppressed. At the center of the end plate 5, heat of compression generated from the compression chambers 16 can be surely dissipated by the thick-walled portion 5A to the cooling air passages 8A through the radiating fins 8. Accordingly, the temperature of the thick-walled portion 5A can be lowered.

Meanwhile, if the whole end plate is formed as a thin-walled plate, thermal resistance becomes high at the center of the end plate, causing the temperature to rise, as shown by the dotted-line characteristic curve 32 in FIG. 4. As a result, the tip seal and other associated members are worn out and damaged at a high rate. If the whole end plate is formed as a thick-walled plate, it becomes easier for heat to be transferred from the center of the end plate to the outer periphery thereof. Therefore, the outer peripheral portion of the end plate rises in temperature, as shown by the chain-line characteristic curve 33 in FIG. 4, causing the intake air to rise in temperature.

According to this embodiment, even in a case where intake air from the suction ports 17 and 18 contacts the thin-walled portion 5B of the end plate 5, the rise in temperature of the intake air can be limited even more reliably. Thus, the intake-air temperature can be lowered, and the compression efficiency during the compression operation can be effectively improved.

The thick-walled portion 5A lying at the center of the end plate 5 enables heat of compression generated from the compression chambers 16 to be effectively radiated from the radiating fins 8 to the outside. Thus, a rise in temperature at the central portion of the end plate 5 an be surely prevented. Accordingly, it is possible to increase the lifetime of the tip seal 22 fitted on the wrap portion 13 of the orbiting scroll member 9, which slidably contacts the end plate 5 of the fixed scroll member 4. Thus, the scroll air compressor can be improved in durability and reliability.

Figure 5:
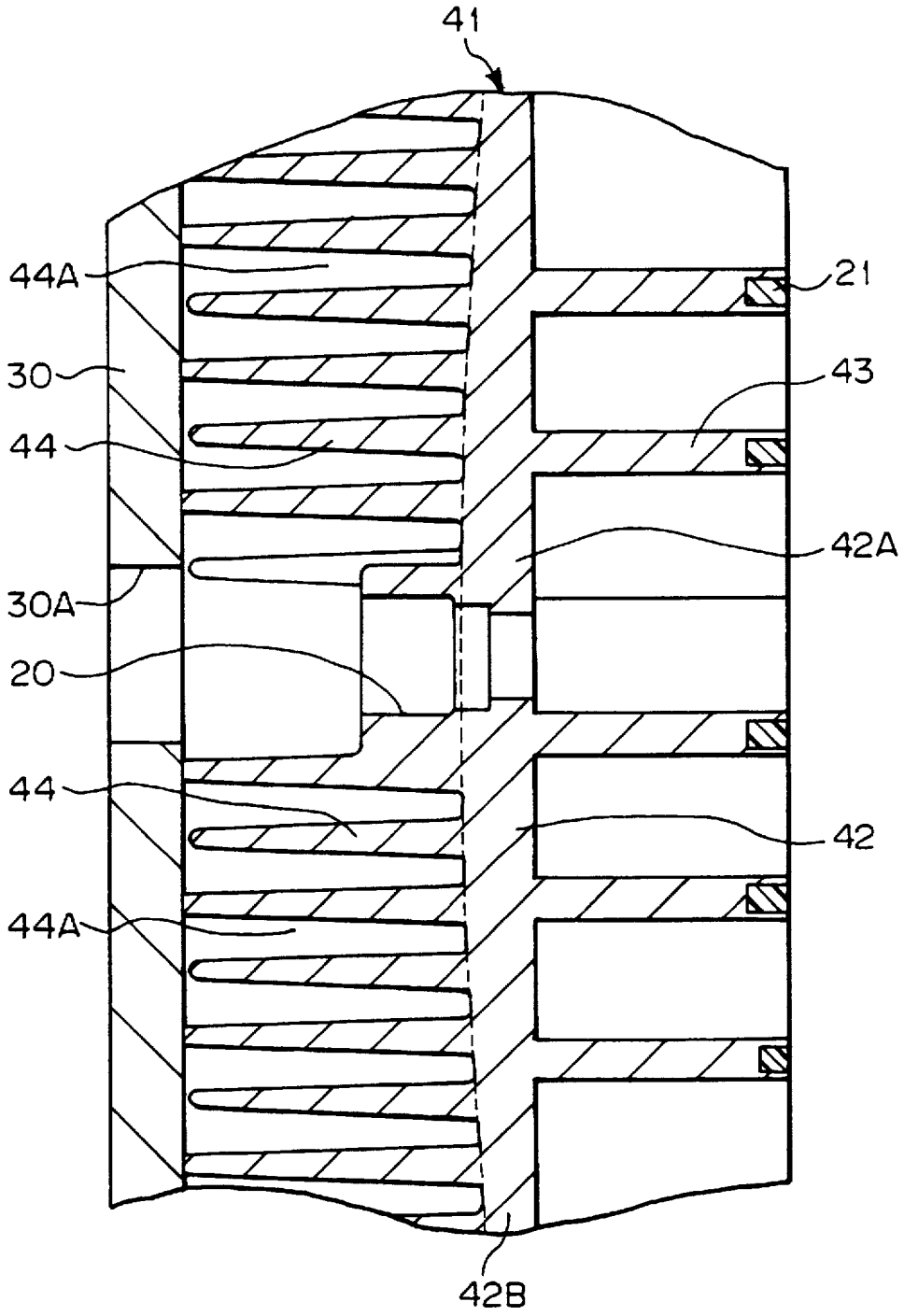
FIG. 5 is a fragmentary sectional view similar to FIG. 2, showing a fixed scroll member and other members of a scroll air compressor according to a second embodiment of the present invention.

FIG. 5 shows a second embodiment of the present invention. In this embodiment, the same constituent elements as those in the first embodiment are denoted by the same reference characters, and description thereof is omitted. A feature of the second embodiment resides in that an end plate 42 of a fixed scroll member 41 is convexly formed such that the central portion of the end plate 42 has the largest thickness, and the plate thickness gradually decreases as the distance from the center of the end plate 42 increases toward the outer periphery thereof.

The fixed scroll member 41 comprises an end plate 42, a wrap portion 43 having a tip seal 21 fitted on the tip thereof, and a plurality of radiating fins 44 in the same way as in the case of the fixed scroll member 4 in the first embodiment. The radiating fins 44 form cooling air passages 44A between them and the duct cover 30. The cooling air passages 44A are linear U-shaped grooves extending parallel to each other. However, the end plate 42 has a convex thick-walled portion 42A at the center thereof. The thickness of the end plate 42 gradually decreases as the distance from the thick-walled portion 42A increases toward the thin-walled portion 42B at the outer periphery. The central portion of the end plate 42 is provided with a discharge port 20 for discharging the compressed air to the outside.

The second embodiment, arranged as described above, provides advantageous effects approximately similar to those in the first embodiment. In the second embodiment, particularly, the thickness of the end plate 42 is continuously varied. Therefore, the mechanical strength of the end plate 42 can be improved, and high durability and high reliability can be obtained.

Figure 6:
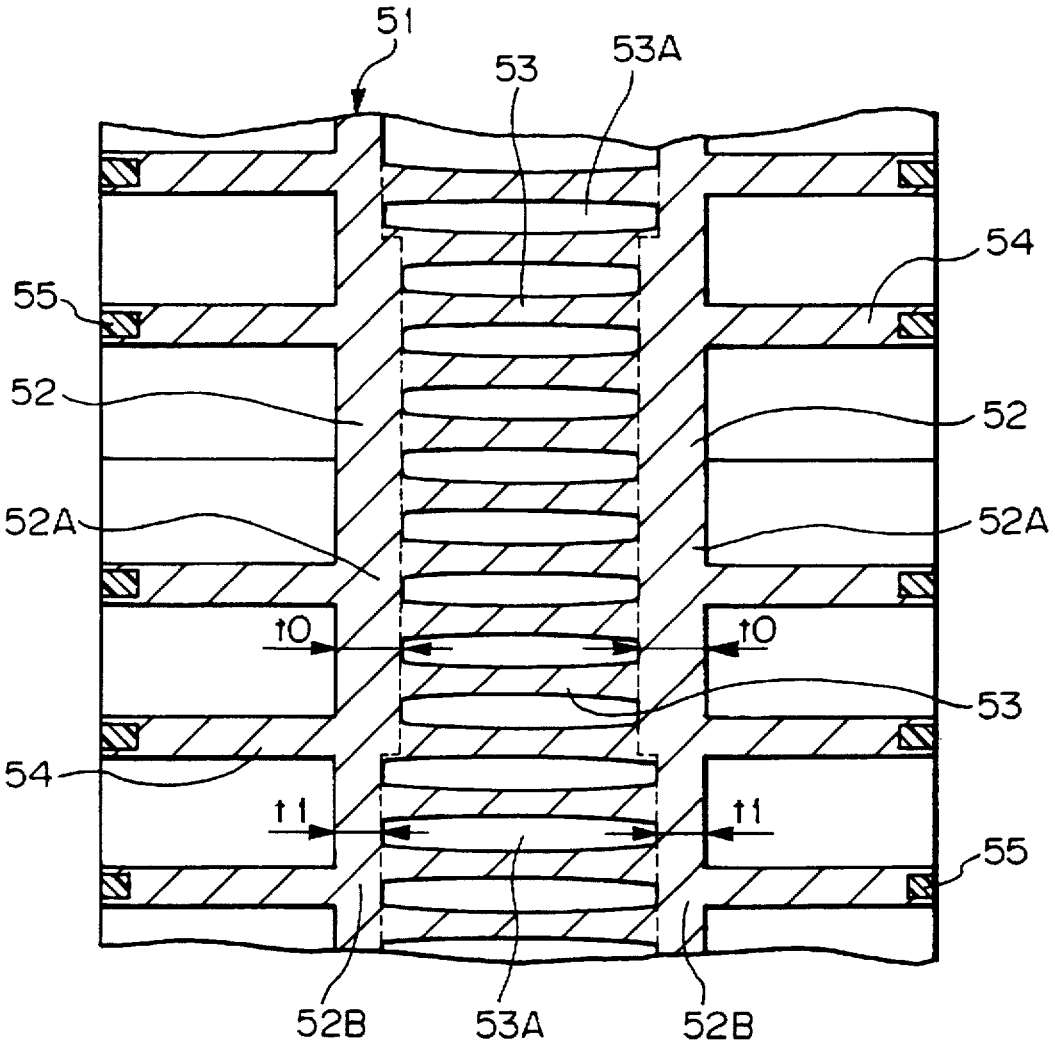
FIG. 6 is a fragmentary sectional view showing an orbiting scroll member and other members of a scroll air compressor according to a third embodiment of the present invention.

FIG. 6 shows a third embodiment of the present invention. This embodiment is characterized in that an orbiting scroll member 51 is integrally formed from a pair of end plates 52 which are disposed to face each other, a plurality of radiating fins 53 which are provided to extend in parallel between the end plates 52. Spiral wrap portions 54 project axially outward from the respective surfaces (flat surfaces) of the end plates 52 on sides thereof which are remote from the sides where the radiating fins 53 are provided. Each end plate 52 has a thick-walled portion 52A with a thickness t0 at the center thereof and a thin-walled portion 52B with a thickness of t1 at the outer periphery thereof, as is the case with the first embodiment.

In the orbiting scroll member 51, cooling air passages 53A are formed between the parallel radiating fins 53 and the end plates 52. Tip seals 55 are fitted on the respective tips of the wrap portions 54.

The orbiting scroll member 51 is orbitably disposed in a cylindrical casing (not shown) such that the orbiting scroll member 51 is sandwiched between a pair of right and left fixed scroll members (not shown). Thus, each wrap portion 54 of the orbiting scroll member 51 defines a plurality of compression chambers (not shown) between it and the wrap portion of the associated fixed scroll member.

The orbiting scroll member 51 is driven to orbit between the two fixed scroll members, causing the compression chambers, which are defined between the orbiting scroll member 51 and the fixed scroll members, to reduce in size continuously. In this way, air sucked in through suction ports (not shown) is successively compressed in the compression chambers, and the compressed air is discharged from discharge ports (not shown) into an external air tank or the like.

The third embodiment, arranged as described above, also provides advantageous effects approximately similar to those in the first embodiment. In the third embodiment, particularly, each end plate 52 of the orbiting scroll member 51 comprises the central thick-walled portion 52A and the outer peripheral thin-walled portion 52B. Accordingly, heat of compression can be efficiently radiated from the thick-walled portion 52A toward the radiating fins 53, and thus the temperature at the thick-walled portion 52A can be lowered. In addition, it is possible to suppress the transfer of heat to the thin-walled portion 52B and hence possible to effectively prevent a rise in temperature of the thin-walled portion 52B.

Although in the foregoing embodiments either the end plate 5 (42) of the fixed scroll member 4 (41) or each end plate 52 of the orbiting scroll member 51 is formed such that the plate thickness is greater at the center of the end plate than at the outer periphery thereof. it should be noted that the present invention is not necessarily limited to the described arrangement, and that the end plates of both the fixed and orbiting scroll members may be formed such that the plate thickness is greater at the center than at the outer periphery.

Although in the foregoing embodiments the present invention has been described by way of an example in which it is applied to a scroll air compressor as a scroll fluid machine, the present invention is not necessarily limited to the scroll air compressor, but may also be widely applied to other scroll fluid machines, e.g., a vacuum pump, a refrigerant compressor, etc.

As has been detailed above, according to the present invention, at least one of the end plates of the fixed and orbiting scroll members is formed such that the plate thickness is greater at the center of the end plate than at the outer periphery thereof. Therefore, high-temperature heat of compression generated in the central compression chamber can be prevented from being transferred from the center of the end plate toward the outer periphery thereof. Accordingly, the temperature (intake temperature) of a fluid sucked in through a suction port at the outer periphery of the end plate can be prevented from being raised by heat from the end plate. Thus, the compression efficiency can be surely improved.

In this case, when a plurality of radiating fins are provided on a side of the end plate which is remote from the side where the wrap portion is provided, heat of compression that is transferred from the compression chambers to the end plate can be efficiently radiated to the outside through the radiating fins. Thus, it is possible to reduce a rise in temperature of the end plate due to the heat of compression and hence possible to increase the lifetime of the tip seal and other associated members. Thus, the scroll fluid machine can be improved in durability and reliability.

What is claimed is:

1. A scroll fluid machine comprising:

a casing;

a fixed scroll member secured to said casing, said fixed scroll member including an end plate having a center area and opposite first and second sides, said center area having therethrough a discharge port, a spiral wrap portion extending from said first side, and radiating fins extending from said second side except at said center area, such that said radiating fins surround said center area;

an orbiting scroll member including an end plate having extending therefrom a spiral wrap portion, said orbiting scroll member being positioned in said casing facing said fixed scroll member with a plurality of compression chambers being defined between said spiral wrap portion of said orbiting scroll member and said spiral wrap portion of said fixed scroll member; and said end plate of said fixed scroll member having a central portion including said center area and a peripheral portion surrounding and extending outwardly from said central portion, said central portion having a thickness greater than a thickness of said peripheral portion.

2. A scroll fluid machine according to claim 1, wherein said central portion of greater thickness comprises means for conducting heat transferred to said end plate of said fixed scroll member from said compression chambers to said radiating fins surrounding said center area.

3. A scroll fluid machine according to claim 1, further comprising a duct cover mounted at a position to closely confront said radiating fins and to define therewith cooling air passages.

4. A scroll fluid machine according to claim 1, wherein said central portion corresponds to 1.5 to 2 turns of said spiral wrap portion of said fixed scroll member from a spiral starting end thereof lying at the center of said end plate thereof.

* * * * *